United States Patent [19]

Bailey et al.

[11] Patent Number: 4,695,116

[45] Date of Patent: Sep. 22, 1987

[54] STACKED ELECTRICAL JACKS

[75] Inventors: James R. Bailey, Chicago; Emma Basov, Des Plaines, both of Ill.

[73] Assignee: Switchcraft, Inc., Chicago, Ill.

[21] Appl. No.: 870,284

[22] Filed: May 21, 1986

Related U.S. Application Data

[63] Continuation of Ser. No. 584,261, Feb. 27, 1984, abandoned.

[51] Int. Cl.[4] ..... H01R 17/18

[52] U.S. Cl. ..... 439/188; 200/51.1; 439/668

[58] Field of Search ..... 339/182, 183, 17 C, 339/17 LC, 17 N, 17 LM, 198 R, 6, 6 A, 19; 200/51.1, 51.12

[56] References Cited

U.S. PATENT DOCUMENTS

| | | | |
|---|---|---|---|
| 2,840,804 | 6/1958 | Rodgers | 200/51.09 |
| 3,288,958 | 11/1966 | Walther et al. | 200/51.09 |
| 3,601,772 | 8/1971 | Mancini | 339/17 LC |
| 3,627,942 | 12/1971 | Bobb | 339/198 G |
| 3,876,274 | 4/1975 | Ruehlemann et al. | 339/17 LC |
| 3,905,673 | 9/1975 | Evans et al. | 339/210 M |
| 4,165,147 | 8/1979 | Buck | 339/17 C |
| 4,239,324 | 12/1980 | Stenz | 339/17 C |

FOREIGN PATENT DOCUMENTS

| | | | |
|---|---|---|---|
| 3119218 | 12/1982 | Fed. Rep. of Germany | 339/183 |
| 912545 | 12/1962 | United Kingdom | 339/183 |

*Primary Examiner*—Gil Weidenfeld
*Assistant Examiner*—David Pirlot
*Attorney, Agent, or Firm*—John T. Meaney; Richard M. Sharkansky

[57] ABSTRACT

A phone jack assembly comprising a piggy-back array of two phone jack housings made of moldable dielectric material and having integral walls defining respective axial cavities wherein a phone jack plug may be inserted; and a plurality of pairs of wire terminals extending downwardly from the lower housing of the array for insertion into respective apertures in a connecting device. Each of the wire terminals is recessed within a respective groove molded into the outer side surfaces of the housings and one of each pair has a portion extended into a cavity of one of the housing for electrical engagement with a portion of a phone jack plug inserted into the cavity. Also each of the wire terminals is provided with a laterally bent portion for pressingly engaging side wall surfaces of the respective groove to support the wire terminal when being inserted into or withdrawn from said respective aperture in the connecting device. The lower housing of the array may have an upper surface provided with a ridge which fits snugly into a channel in the lower surface of the overlying housing in the array; and some of the wire terminals recessed in said groove extend over the top surface of the upper housing in the array to aid in holding the housings of the array together as an assembly when being mated to or disconnected from said connector device.

16 Claims, 27 Drawing Figures

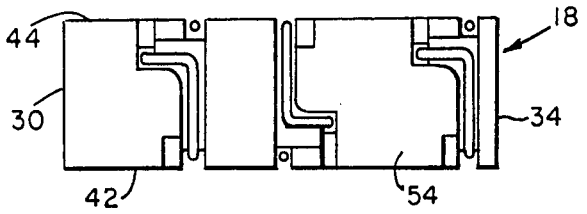
FIG. 2F
FIG. 2D
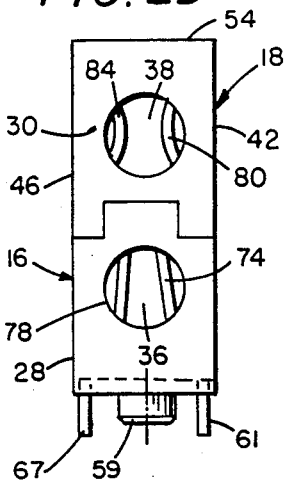
FIG. 2A
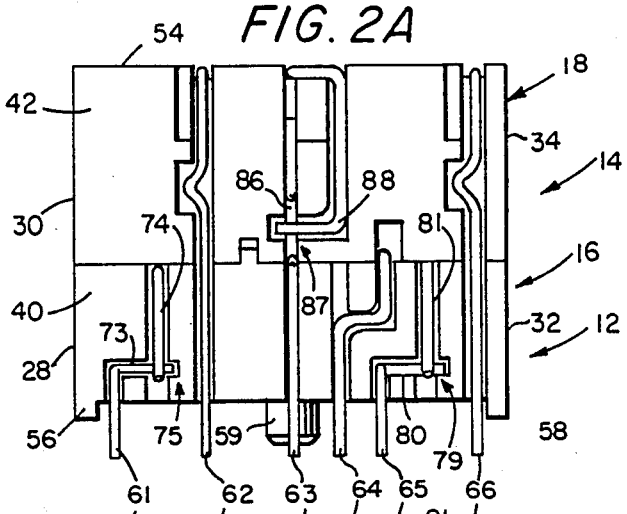
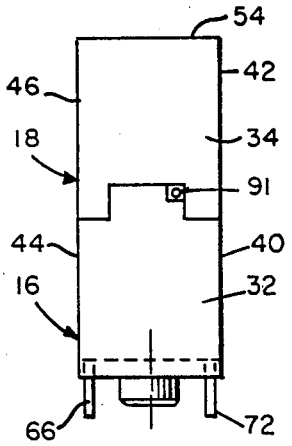
FIG. 2E
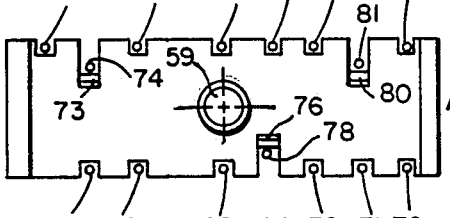
FIG. 2B
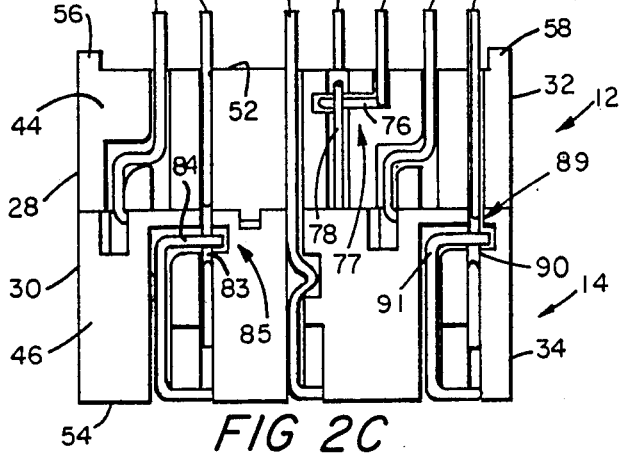
FIG 2C

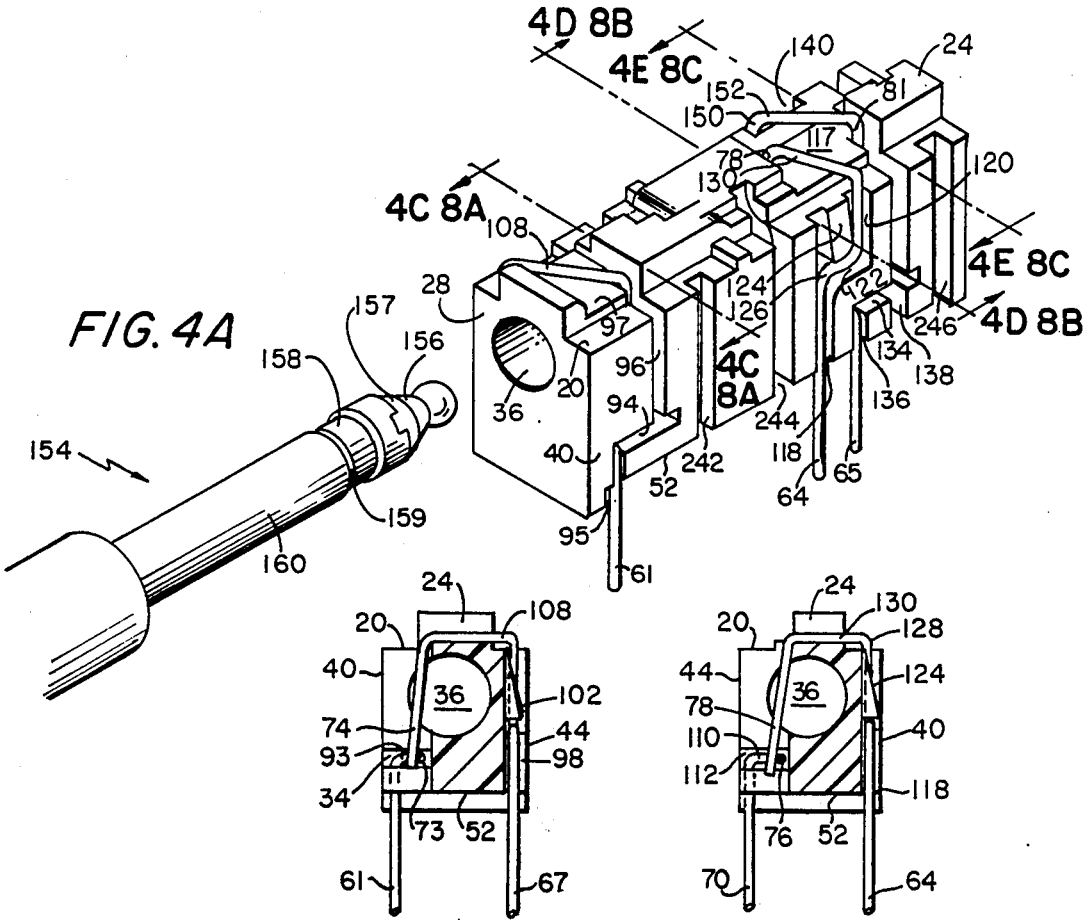
FIG. 4A
FIG. 4C
FIG. 4D
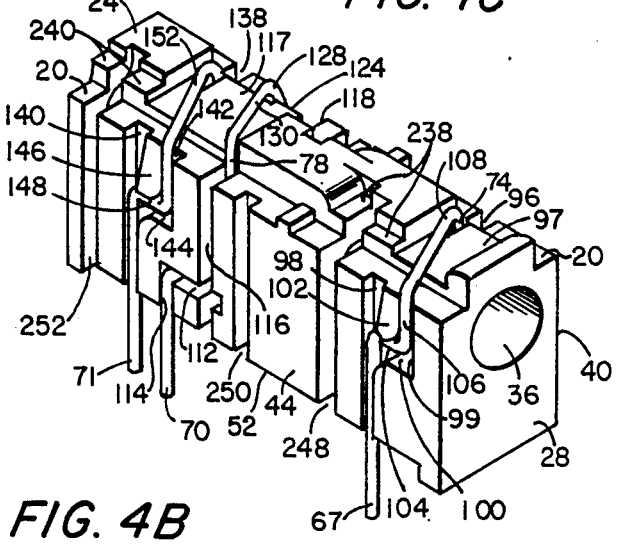
FIG. 4B
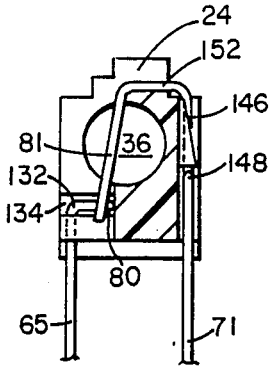
FIG. 4E

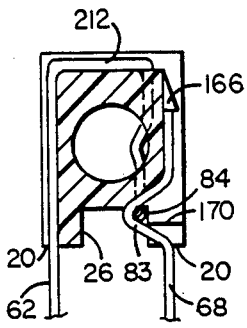
FIG. 6C
FIG. 6D
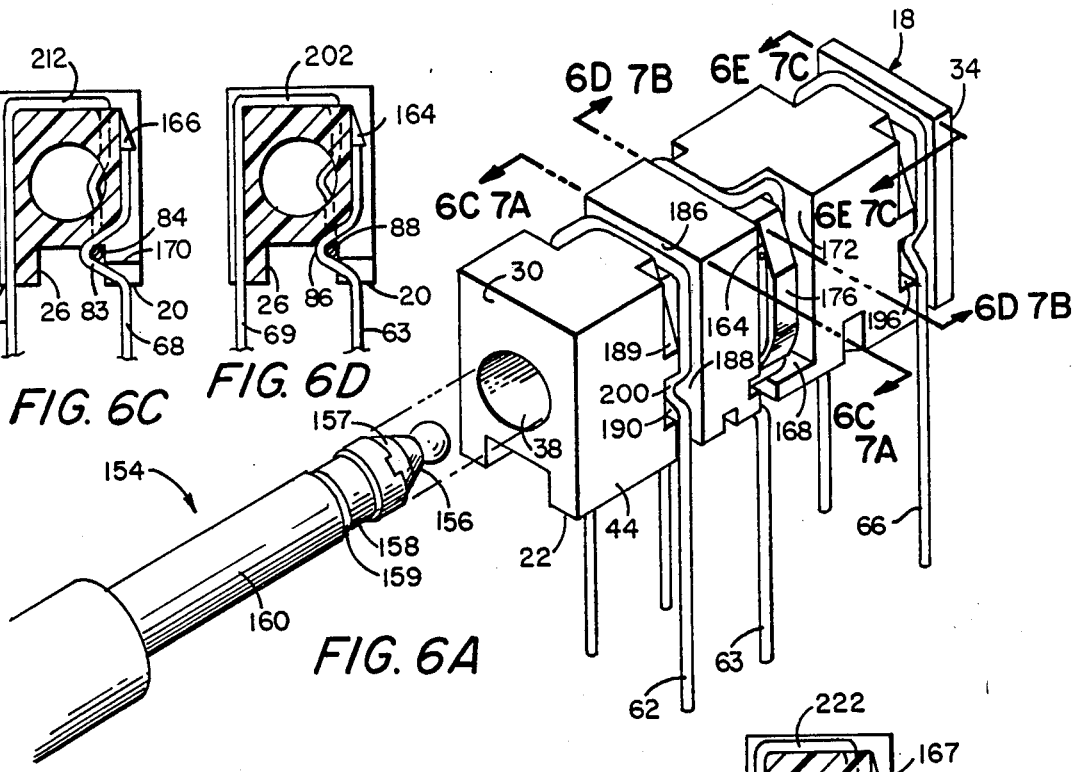
FIG. 6A
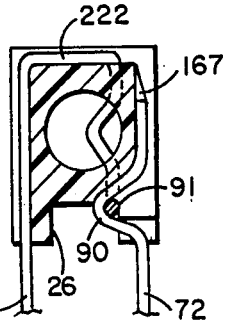
FIG. 6E
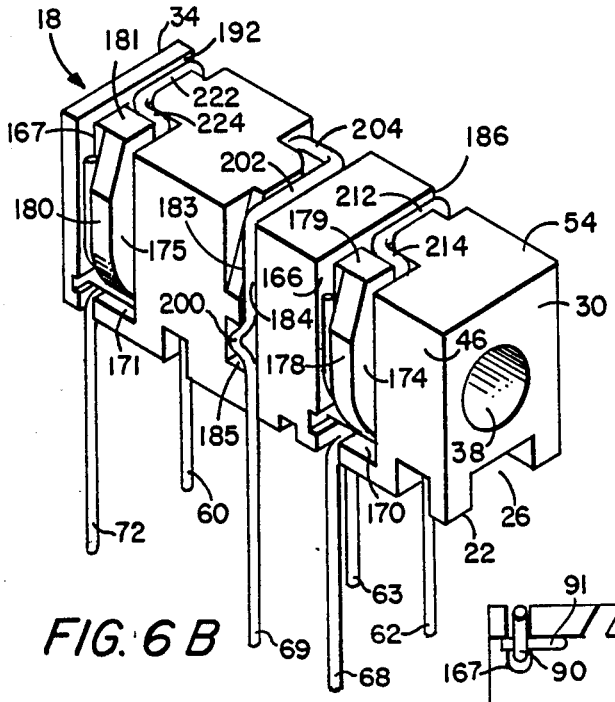
FIG. 6B
FIG. 6F
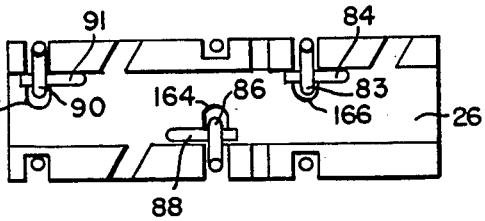

STACKED ELECTRICAL JACKS

This application is a continuation of application Ser. No. 584,261 filed Feb. 27, 1984 now abandoned.

BACKGROUND OF THE INVENTION

1. Field of the Invention

This invention relates generally to electrical jack devices and is concerned more particularly with a ganged array of electrical jacks having space-saving terminal means disposed for resisting insertion pressures.

2. Discussion of the Prior Art

An electronic system, such as a telephone communication system, for example, may be provided with a plurality of electrical jacks, each comprising a dielectric housing having an axial cavity wherein an electrical plug may be inserted for engaging respective spring contacts to open, close or otherwise change connecting electrical circuitry. Each of the electrical jacks may have its dielectric housing mounted on a printed circuit board by having an array of protruding terminals inserted into respective aligned holes in the dielectric panel of the printed circuit board. The terminals of the electrical jacks usually are mutually spaced in the respective array, and generally are made of stamped sheet-metal which is plated with suitable conductive material, such as gold, for example.

Since space on a printed circuit board generally is at a premium, the trend has been to use more miniaturized components and to position the associated arrays of terminal-receiving holes closer together. On the other hand, sheet-metal terminals of conventional electrical jacks restrict the extent to which these electrical jacks can be miniturized. Consequently, attempts have been made to dispose the electrical jacks in ganged arrays, such as in side-by-side relationship, for example, in order to position the associated arrays of mutually spaced holes in the printed circuit board closer together correspondingly. However, the amount that the mutually spaced holes can be positioned closer together in the printed circuit board is limited by the slotted configurations thereof required for receiving the sheet-metal terminals.

SUMMARY OF THE INVENTION

Accordingly, these and other disadvantages of the prior art are overcome by this invention providing a vertically stacked pair of upper and lower electrical jack modules having respective first and second arrays of wire terminals disposed in intervening mutually spaced relationship to form a common array of wire terminals. Thus, the common array of wire terminals may be inserted into a similar array of holes occupying less space on a connecting electrical member, such as a printed circuit board, for example, than the space occupied by a suitable array of holes for receiving respective terminals which protrude from a side-by-side ganged pair of equivalent size modules. Also, each of the wire terminals in the common array requires less space and a smaller size receiving hole than required for the conventional sheet-metal terminal. Consequently, the respective wire terminals of the common array and the associated holes in the connecting electrical member may be positioned closer together than the conventional sheet-metal terminals and the associated holes of the prior art.

Each of the modules in the vertically stacked pair comprises a dielectric housing provided with an axial bore having an open end into which an electrical plug may be slidably inserted. Also, each of housings supports a plurality of switch components having respective stationary and movable elements made of the same wire material as the terminals and integrally joined through respective intermediate lengths to respective wire terminals of the common array. Thus, having the respective stationary and moveable elements of the switch components made of wire material provides means for further miniaturizing the assembly or providing a greater density of switch components in the respective upper and lower modules of the assembly.

The housing of the upper and lower jack modules may be provided with respective interfitting means for orienting the modules one to another, such that the open ends of their axial bores are disposed at the same end of the assembly, for example. Thus, a twin electrical plug may have respective probes insered into the open ends of the bores in the upper and lower modules simultaneously. The interfitting means also serves to restrict lateral movement of the upper and lower module housings and provides the assembly with a unistructural appearance.

Each of the housings may have opposing longitudinal side surfaces provided with a plurality of mutually spaced grooves extended in the vertical direction and aligned with a respective wire terminal of the common array. The integral intermediate lengths of the wire material are press-fitted into respective grooves in the longitudinal side surfaces of the housings whereby the housings are interlocked with one another and resist any pressure forces exerted in appropriate directions for pulling them apart. Also, each of said grooves is provided with a lateral extending portion or recess which receives a laterally bent portion of the intermediate length of wire material press-fitted therein. These laterally bent portions of the intermediate lengths of wire material act against the side surfaces of the recesses in resisting any pressure exerted when the common array of wire terminals is inserted into a similar array of holes in a connecting electrical member.

BRIEF DESCRIPTION OF THE DRAWINGS

For a better understanding of the disclosed invention, reference is made in the following detailed description to the accompanying drawings wherein:

FIG. 2A is an elevational view of the longitudinal side of the electrical jack assembly shown in FIG. 1B;

FIG. 2B is a bottom plan view of the electrical jack assembly shown in FIG. 2A;

FIG. 2C is an elevational view of the opposing longitudinal side of the electrical jack assembly shown in FIG. 2A;

FIG. 2D is a top plan view of the electrical jack assembly shown in FIG. 2A;

FIG. 2E is an elevational view of the plug entrance end of the electrical jack assembly shown in FIG. 2A;

FIG. 2F is an elevational view of the opposing or non-entrance end of the electrical jack assembly shown in FIG. 2A;

FIG. 4A is an assembled isometric view of the lower jack module shown in FIG. 3, as seen from the plug entrance end and the same longitudinal side of said lower jack module;

FIG. 4B is an assembled isometric view of the lower jack module shown in FIG. 4A but as seen from the entrance end and the opposing longitudinal side of said lower jack module;

FIGS. 4C-4E are transverse sectional views taken along respective lines 4C—4C, 4D—4D and 4E—4E in FIG. 4A and looking in the directions of the arrows to show the unactuated conditions of the switch components in the lower jack module;

FIG. 6A is an assembled isometric view of the upper jack module shown in FIG. 5 as seen from the entrance end and the same longitudinal side as shown in FIG. 5;

FIG. 6B is an assembled isometric view of the upper jack module shown in FIG. 6A but as seen from the entrance end and the opposing longitudinal side of said lower jack module;

FIGS. 6C-6E are transverse sectional views taken along respective lines 6C—6C, 6D—6D and 6E—6E in FIG. 6A and looking in the directions of the arrows to show the unactuated conditions of the switch components in the upper jack module;

FIG. 6F is a bottom plan view of the upper jack module shown in FIG. 6B;

DESCRIPTION OF THE PREFERRED EMBODIMENT

Figure 1A:
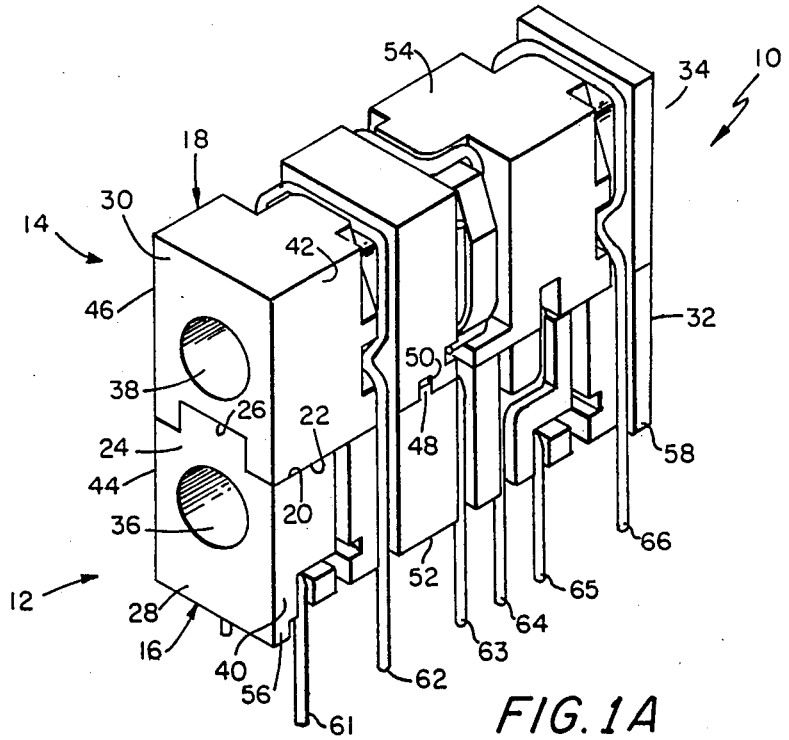
FIG. 1A is an isometric view of an electrical jack assembly embodying the invention, as seen from the plug entrance end and one longitudinal side of the assembly.
Figure 1B:
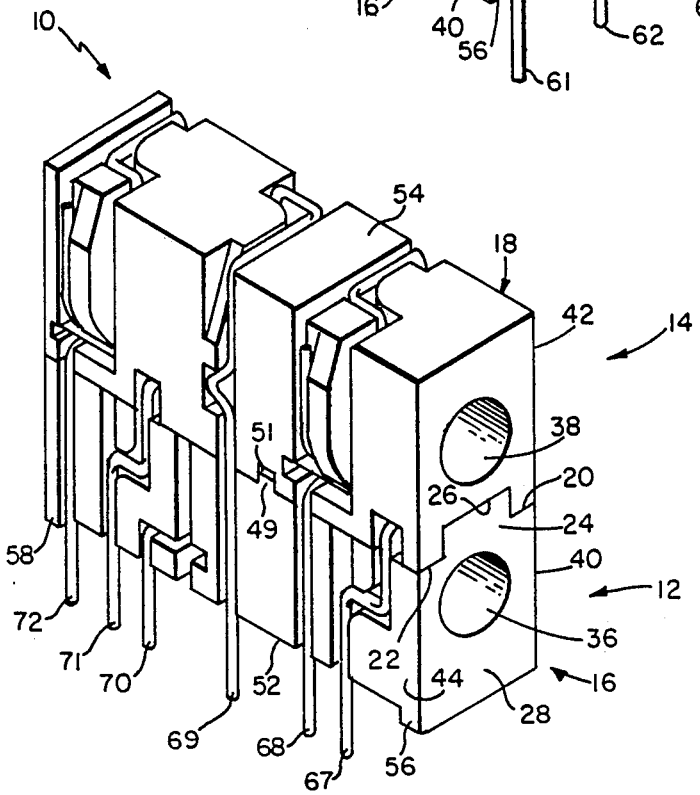
FIG. 1B is an isometric view of the electrical jack assembly shown in FIG. 1A but as seen from the plug entrance end and the opposing longitudinal side of the assembly.

Referring to the drawings wherein like characters of reference designate like parts, there is shown in FIGS. 1A and 1B an electrical jack assembly 10 comprised of a vertically stacked pair of modules including a lower jack module 12 supporting an upper jack module 14. The modules 12 and 14 have similar elongated block-like housings, 16 and 18, respectively, which are substantially equal in size and are made of dielectric material, such as a moldable plastic material, for example. Housings 16 and 18 have respective upper and lower mating surfaces 20 and 22 which are provided with interfitting means comprising a plateau-like axial ridge 24 protruding upwardly from the surface 20 and fitting snugly into a complementary shaped axial slot 26 disposed in the surface 22. Thus, the interlocking ridge 24 and slot 26 provide means for restricting lateral movement of the respective housings 16 and 18 relative to one another.

The housings 16 and 18 have respective entrance end surfaces 28 and 30 which are disposed substantially flush with one another, and have opposing non-entrance end surfaces 32 and 34, respectively, which also may be disposed very nearly flush with one another. Centrally disposed in the entrance end surfaces 28 and 30 are open ends of respective axial bores 36 and 38, each of which is disposed for slidably receiving therein a cylindrical electrical plug, as shown in FIGS. 4A, 6A, 7A-7C and 8A-8C, for example. The housings 16 and 18 have respective adjacent longitudinal side surfaces 40 and 42 which may be disposed substantially flush with one another, and respective opposing longitudinal side surfaces 44 and 46 which also may be disposed substantially flush with one another.

An integral mesa-like boss or key 48 protrudes upwardly from a marginal portion of upper surface 20 adjacent the longitudinal side surface 40 of housing 16 and fits snugly into an aligned notch or keyway 50 disposed in the lower surface 22 of housing 18. The key 48 is aligned transversely of housing 16 with a similar integral mesa-like boss or key 49 protruding upwardly from the surface 20 of housing 16 and fitting snugly into an aligned notch or keyway 51 disposed in the mating surface 22 of housing 18. The bosses or keys 48-49 and the respective interlocking notches on keyways 50-51 are located closer to the respective entrance end surfaces 28 and 30 than to the respective non-entrance end surfaces 32 and 34 for the purpose of orienting the respective housings 16 and 18 relative to another such that the respective bores 36 and 38 are disposed at the same end of the assembly 10. Also, the bosses or keys 48-49 and the respective interlocking notches or keyways 50-51 provide interfitting means for restricting longitudinal movement of the respective housings 16 and 18 relative to one another, particularly when a cylindrical electrical plug is inserted axially into one of the bores 36 and 38, respectively.

The housing 16 is provided with a lower surface 52 which constitutes the bottom surface of assembly 10; and the housing 18 is provided with an upper surface 54 which constitutes the top surface of assembly 10. Extending downwardly from opposing marginal end portions of the surface 52 are respective legs 56 and 58 which are adapted to contact a mounting surface of a connecting electrical member (not shown), such as a printed circuit board, for example. A linear series of mutually spaced terminals 61-66, respectively, extends downwardly from the longitudinal side surface 40 of housing 16; and a similar linear series of mutually spaced terminals 67-72, respectively, extends downwardly from the opposing longitudinal side surface 44 of housing 16. Each of the respective terminals 61-72 is made of suitable resilient wire material, such as beryllium-copper having a diameter of about twenty-five thousandths of an inch, for example. Thus, the respective wire terminals 61-72 form a common array which extends beyond the legs 56 and 58 for insertion into a similar array of holes in a connecting electrical member, such as a printed circuit board, for example.

As shown in FIGS. 2A-2E, the lower surface 52 of housing 16 may have a central portion provided with an integral post 59 which extends from the surface 52 a greater distance than the respective legs 56 and 58. Post 59 is designed to be inserted slidably into a closely-fitting aperture centrally disposed in the array of terminal-receiving holes in a connecting electrical device (not shown), such as a printed circuit board, for example. Thus, the post 59 serves to restrict relative lateral movement between the electrical jack assembly 10 and the connecting device to prevent damaging the wire terminals 61-72 insered into respective holes of the array in the connecting device.

The wire terminal 61 is integrally connected to a stationary spring contact member 73 of an electrical switch 75 disposed in the longitudinal side surface 40 of housing 16. Switch 75 has a moveable spring contact member 74 made of resilient wire provided with a suitable configuration for extending obliquely through a portion of axial bore 36 adjacent side surface 40, transversely over upper surface 20, and downwardly of longitudinal side surface 44 to the lower surface 52 of housing 16, where it is integrally joined to the wire terminal 67. Due to the resiliency of its wire material, the moveable spring contact member 74 is biased into electrical engagement with stationary spring contact member 73 for maintaining the switch 75 in a normally closed condition.

Similarly, the wire terminal 65 is integrally connected to a stationary spring contact member 80 of an electrical switch 79 disposed in the longitudinal side surface 40 of housing 16. Switch 75 also has a moveable spring contact member 81 made of resilient wire provided with a suitable configuration for extending obliquely through a portion of axial bore 36 adjacent side surface 40, transversely over upper surface 20, and downwardly of longitudinally side surface 44 to the lower surface 52 of housing 16, where it is integrally joined to the wire terminal 71. Thus, due to the resiliency of its wire material, the moveable spring contact member 81 also is biased into electrical engagement with the stationary spring contact member 80 for maintaining the electrical switch 79 in a normally closed condition.

Moreover, the wire terminal 70 is integrally connected to a stationary spring contact member 76 of an electrical switch 77 disposed in the longitudinal side surface 44 of housing 16. Switch 77 has a moveable spring contact member 78 made of resilient wire provided with a suitable configuration for extending obliquely through a portion of axial bore 36 adjacent side surface 44, transversely over upperr surface 20, and downwardly of longitudinal side surface 40 to the lower surface 52 of housing 16, where it is integrally joined to the wire terminal 64. Accordingly, due to the resiliency of its wire material, the moveable spring contact member 78 also is biased into electrical engagement with the stationary spring contact member 76 for maintaining the electrical switch 77 in a normally closed condition.

Thus, the lower jack module 12 is provided with three electrical switches 75, 77 and 79, respectively, the switches 75 and 79 being disposed in the longitudinal side surface 40 and the switch 77 being disposed in the opposing longitudinal side surface 44 of housing 16. Furthermore, the switch 75 has respective stationary and moveable contact members 73 and 74 connected integrally to wire terminals 61 and 67, respectively. Also, the switch 77 has respective stationary and moveable contact members 76 and 78 connected integrally to wire terminals 70 and 64, respectively. Moreover, the switch 79 has respective stationary and moveable contact members 80 amd 81 connected integrally to wire terminals 65 and 71, respectively. Accordingly, the lower jack module 12 has a first array of mutually spaced terminals comprised of respective wire terminals 61, 64, 65, 67, 70 and 71 which extend from the lower surface 52 and form part of the common array of terminals 61–72, respectively, for the electrical jack assembly 10.

Also, as shown in FIGS. 2A–2F, the wire terminal 68 is connected integrally to a stationary spring contact member 82 of an electrical switch 83 disposed in the longitudinal side surface 46 of the upper housing 18. Switch 83 has a moveable spring contact member 85 provided with a suitable configuration for projecting into a portion of axial bore 38 adjacent side surface 46, transversely over upper surface 54 and downwardly of longitudinal side surfaces 42 and 40, respectively, to the lower surface 52 of assembly 10, where it is integrally joined to the wire terminal 62. Due to the resiliency of its wire material, the moveable spring contact member 84 is biased into electrical engagement with the stationary spring contact member 82 for maintaining the electrical switch in a normally closed condition.

Similarly, the wire terminal 72 is integrally connected to a stationary spring contact member 90 of an electrical switch 89 disposed in the longitudinal side surface 46 of housing 18. Switch 89 has a moveable spring contact member 91 provided with a suitable configuration for projecting into a portion of axial bore 38 adjacent side surface 46, transversely over upper surface 54, and downwardly of longitudinal side surfaces 42 and 40, respectively, to the lower surface 52 of assembly 10, where it is integrally joined to the wire terminal 66. Furthermore, due to the resiliency of its wire material, the moveable spring contact member 91 is biased into electrical engagement with the stationary spring contact member 90 for maintaining the electrical switch 89 in a normally closed condition.

Moreover, the wire terminal 63 is integrally connected to a stationary spring contact member 86 of an electrical switch 87 disposed in the longitudinal side surface 42 of housing 18. Switch 87 has a moveable spring contact member 88 provided with a suitable configuration for projecting into a portion of axial bore 38 adjacent side surface 42, transversely over upper surface 54 and downwardly of longitudinally side surfaces 46 and 44, respectively, to the lower surface 52 of assembly 10, where it is integrally joined to the wire terminal 69. Also, due to the resiliency of its wire material, the moveable spring contact member 88 is biased into electrical engagement with the stationary spring contact member 86 for maintaining the electrical switch 87 in a normally closed condition.

Thus, the upper jack module 14 is provided with three electrical switches 85, 87 and 89, respectively, the switches 85 and 89 being disposed in the longitudinal side surface 46 and the switch 87 being disposed in the opposing longitudinal side surface 42 of housing 18. Furthermore, the switch 85 has respective stationary and moveable contact members 83 and 84 connected integrally to wire terminals 68 and 62, respectively. Also, the switch 87 has respective stationary and moveable contact members 86 and 88 connected integrally to wire terminals 63 and 69, respectively. Moreover, the switch 89 has respective stationary and moveable contact members 90 and 91 connected integrally to wire terminals 72 and 66, respectively. Accordingly, the upper jack module 14 has a second array of mutually spaced terminals comprised of respective wire terminals 62, 63, 66, 68, 69 and 72 which extend from the lower surface 52 in intervening spaced relationship with said first array of terminals of the lower jack module 12 to form a part of the common array of terminals 61–72, respectively, for the electrical jack assembly 10.

As shown in FIGS. 3 and 4A–4E, the terminal 61 comprises an end portion of a wire having an intermediate portion 93 which is bent orthogonally inward of housing 16. Intermediate portion 93 is integrally connected to a coplanar orthogonally bent end portion of the wire comprising stationary contact member 73 which is directed longitudinally of housing 16 and toward the end surface 32 thereof. The wire end portion comprising stationary contact member 73 and the coplanar intermediate portion 93 are press-fitted into a slot 94 in the longitudinal side wall 40 of housing 16 to the extent that the stationary contact member 73 is disposed against the innermost wall of slot 94. The intermediate portion 93 is disposed against an end wall of slot 94 which has portion adjacent side surface 40 extended into a communicating groove 95 wherein the terminal end portion 61 of the wire is press-fitted Groove 95 extends vertically of the side surface 40 and communicates with the lower surface 52 of housing 16 from which the wire terminal 61 extends.

Terminating in the opposing end portion of slot 94 is a slot 96 disposed vertically in side surface 40 sufficiently deep to communicate with the bore 36. The vertical slot 96 terminates at its other end in upper surface 20 of housing 16 and adjacent a recessed landing 97 in the ridge 24. Transversely aligned with the slot 96 on the other side of ridge 24 is a vertical groove 98 in side surface 44 which extends from upper surface 20 to the lower surface 52 of housing 16. A parallel groove 99 in side surface 44 extends downward from the upper surface 20 to an orthogonal groove 100 which communicates with the goove 98. A portion of the longitudinal side surface 44 between the respective grooves 98 and 99 comprises a cam surface 102 which slopes outwardly from the surface 20 of housing 16 and terminates at the groove 100.

Terminal 67 comprises an end portion of a wire which is fitted into the groove 98 adjacent upper surface 20 of housing 16 and is urged downwardly during installation. The terminal end portion 67 of the wire is integrally connected to an orthogonally stepped portion 104 which rides over the cam surface 102 and snaps into the groove 100 during installation. Stepped portion 104 is integrally connected to an orthogonal riser portion 106 of the wire which snaps into the groove 99 when the stepped portion 104 snaps into the groove 100 during installation. The riser portion 106 is integrally connected to orthogonally bent portion 108 which extends obliquely over the recessed landing 97 and is seated on it when installation is completed. Portion 108 of the wire is integrally connected to an orthogonally bent end portion thereof comprising the moveable contact member 74 which, during installation, is urged down the slot 96 and passes obliquely through an adjacent portion of axial bore 36. At the slot 34, the moveable contact member 74 is sprung outwardly sufficiently to pass over the stationary contact member 73 and snap back into electrical engagement with it.

Similarly, the terminal 70 comprises an end portion of a wire having an intermediate portion 110 bent orthogonally inward of housing 16. Intermediate portion 110 is integrally connected to a coplanar, orthogonally bent end portion comprising stationary contact member 76 which is directed longitudinally of housing 16 and toward entrance end surface 28 thereof. The wire end portion comprising stationary contact member 76 and the coplanar intermediate portion 110 are press-fitted into a slot 112 in the longitudinal side wall 44 of housing 16 to the extent that the stationary contact member 76 is disposed against the innermost wall of slot 112. The intermediate portion 110 is disposed adjacent an end wall of slot 112 which has a portion adjacent side surface 44 extended into a communicating groove 114 wherein the terminal end portion 70 of the wire is press-fitted. Groove 114 extends vertically of the side 44 and communicates with the lower surface 52 of housing 16 from which the wire terminal 70 extends.

An opposing end portion of slot 113 is open to a slot 116 which is disposed vertically in side surface 44 sufficiently deep to communicate with the axial bore 36. The vertical slot 116 terminates at its other end in upper surface 20 of housing 16 adjacent a recessed landing 117 in ridge 24, and is aligned transversely of housing 16 with a groove 118 which extends vertically in longitudinal side surface 40 from upper surface 20 to lower surface 52 of housing 16. Disposed in the side surface 40 and parallel with the groove 118 is another groove 120 which extends from the upper surface 20 of housing 16 to an orthogonal groove 122 which communicates with the groove 118. A portion of the side surface 40 between the respective grooves 118 and 120 comprises a cam surface 124 which slopes outwardly from the surface 20 of housing 16 and terminates at the groove 122.

Terminal 64 comprises an end portion of a wire which is fitted into groove 118 adjacent upper surface 20 of housing 16 and is urged downwardly during installation. The terminal end portion 64 of the wire is integrally connected to an orthogonal stepped portion 126 which rides over the cam surface 124 and snaps into the groove 122 during installation. Stepped portion 126 is integrally connected to an orthogonal riser portion 128 which snaps into the groove 120 when the stepped portion 126 snaps into the groove 122. The riser portion 128 is integrally connected to an orthogonally bent bright portion 130 which extends at an angle across the recessed landing 117 in ridge 24, and is seated thereon when installation is completed. Simultaneously, during installation, an orthogonally bent end portion connected to portion 130 and comprising moveable contact member 78 is urged down the slot 116 and passes obliquely through an adjacent portion of axial bore 36. At the slot 112, the moveable contact member is sprung outward sufficiently to pass over the stationary contact member 76 and allowed to snap back, by virtue of its resilient wire material, into electrical engagement with the stationary contact member 76.

Moreover, the terminal 65 comprises an end portion of a wire having an intermediate portion 132 bent orthogonally inward of housing 16. Intermediate portion 132 is integrally connected to a coplanar, orthogonally bent end portion comprising stationary contact member 80 which is directed longitudinally of housing 16 and toward the end surface 32 thereof. The wire end portion comprising stationary contact member 80 and the coplanar intermediate portion 132 are press-fitted into a slot 134 in the longitudinal side surface 40 of housing 16 to the extent that the stationary contact member 80 is disposed against the innermost wall of slot 134. The intermediate portion 132 is disposed adjacent an end wall of slot 134 which has a portion adjacent side surface 40 extended into a communicating groove 136 wherein the terminal end portion 65 is press-fitted. Groove 136 extends vertically of the side surface 40 and communicates with the lower surface 52 of housing 16 from which the wire terminal 65 extends.

An opposing end portion of slot 134 is open to a slot 138 which is disposed vertically in side surface 40 sufficiently deep to communicate with the axial bore 36. The vertical slot 138 terminates at its other end in upper surface 20 of housing 16 adjacent the recessed landing 117 in ridge 24, and is aligned transversely of housing 16 with a groove 140 which extends vertically in longitudinal side surface 44 from upper surface 20 to lower surface 52 of housing 16. Disposed in the side surface 40 and parallel with the groove 140 is another groove 142 extending from upper surface 20 to an orthogonal groove 144 which communicates with the groove 140. A portion of the side surface 40 between the respective grooves 140 and 142 comprises a cam surface 146 which slopes outwardly from surface 20 of housing 16 and terminates at the groove 144.

Terminal 71 comprises an end portion of a wire which is fitted into groove 140 adjacent upper surface 20 of housing 16 and is urged downwardly during installation. The terminal end portion 71 of the wire is integrally connected to an orthogonal stepped portion 148 which rides over the cam surface 146 and snaps into the groove 144 during installation. Stepped portion 148 is integrally connected to an orthogonal riser portion 150 which snaps into the groove 142 when the stepped portion 148 snaps into the groove 144. The riser portion 150 is integrally connected to an orthogonal bent bight portion 152 which extends at an angle across the recessed landing 117 in ridge 24, and is seated thereon when installation is completed. Simultaneously, during installation, an orthogonally bent end portion integrally connected to the bight portion 152 and comprising the moveable contact member 81 is urged downwardly in the slot 138 and passes obliquely through an adjacent portion of the axial bore 36. At the slot 134, the moveable contact member 81 is sprung outward sufficiently to pass over the stationary contact member 80 and is allowed to snap back resiliently into electrical engagement with the stationary contact member 80.

Thus, the jack module 12 is provided with a first array of wire terminal end portions 61, 64, 65, 67, 70 and 71 which are disposed within the longitudinal side surfaces 40 an 44, respectively, and extend from the lower surface 52 of housing 16. The terminal end portions 61, 70 and 65 are integrally connected to the stationary contact members 73, 76 and 80, respectively; and the terminal end portions 67, 64 and 71 are integrally connected to the moveable contact members 74, 78 and 81, respectively. Accordingly, when the wire terminals 61, 70 and 65 are urged axially into respective close-fitting holes in a connecting device (not shown) the resulting pressure forces transmitted through these terminals are resisted by the respective intermediate portions 93, 110 and 132 bearing against the upper or roof-like walls of slots 94, 112, and 134, respectively. Also, when the wire terminals 61, 70 and 65 are withdrawn from the close-fitting holes, the resulting pulling force transmitted through these terminals is resisted by the intermediate portions 93, 110 and 132 bearing against the lower or floor-like walls of the slots 94, 112 and 134, respectively. Hence, each of the intermediate portions 93, 110, and 132 is provided with a laterally bent portions for protecting the stationary contact members 73, 76 and 80 from pressing or pulling forces exerted on the integrally connected terminal end portions 61, 70 and 65, respectively.

Also, when the wire terminals 67, 64 and 71 are urged axially into respective close-fitting holes in a connecting device (not shown) the resulting pressure forces transmitted through these terminals are resisted by the respective stepped portions 104, 126 and 148 bearing against the upper wall portions of grooves 99, 122 and 144, respectively. Moreover, when the wire terminals 67, 64 and 71 are withdrawn from the close-fitting holes, the resulting pulling forces transmitted through the terminals 67, 64 and 71, respectively, are resisted by the stepped portions 104, 126 and 148 bearing against the lower wall portions of grooves 99, 122 and 144, respectively. Therefore, each of the intermediate wire portions between terminals 67, 64 and 71 moveable contact members 74, 78 and 81, respectively, are provided with laterally bent portions for protecting the moveable contact members from pressing or pulling forces exerted on the integrally connected terminal end portions 67, 64 and 71, respectively.

As shown in FIG. 4A, in operation, there may be inserted axially into the bore 36 a conventional cylindrical plug 154 having along its length a conductive tip portion 156 insulated by a dielectric spacer 157 from a conductive ring portion 158 which is insulated by a dielectric spacer 159 from a conductive sleeve portion 160. The respective conductive portions 156, 158 and 160 of plug 154 may be provided with respective diametric sized which increase from the size of tip portion 156 to the size of sleeve portion 160. Thus, when the plug 154 is inserted axially into bore 36 the tip portion 156 may engage only the moveable contact member 74, the ring portion 158 may engage only the moveable contact member 78 and the sleeve portion 106 may engage only the moveable contact member 81. Therefore, it is apparent that the moveable contact members 74, 78 and 106 may protrude into the bore 36 respective distances determined by the dimensions and orientations of bight portions 108, 130 and 152, respectively, relative to the axial centerline of bore 36.

Figure 8A:
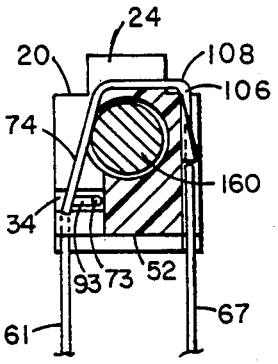
FIGS. 8A-8C are respective transverse sectional views of the lower jack module shown in FIGS. 4A-4B and illustrating actuated conditions of the respective component switches depicted in FIGS. 4C-4E.
Figure 8B:
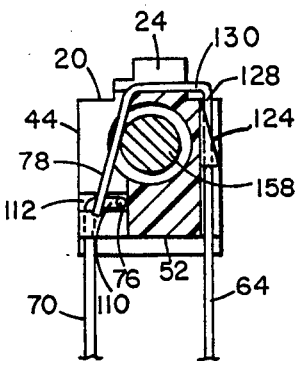
Figure 8C:
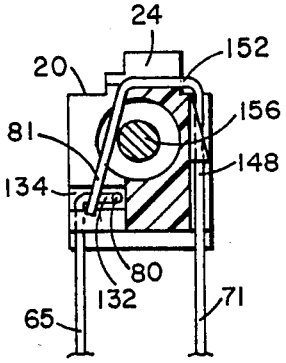

As shown in FIG. 8C, when the tip portion 156 engages moveable contact member 74, the contact member 74 is pivoted out of electrical engagement within the stationary contact member 73 which opens electrical switch 75. As shown in FIG. 8B, when the ring portion 158 engages moveable contact member 78, the contact member 78 is pivoted out of electrical engagement with the stationary contact member 76 which opens the electrical switch 77. As shown in FIG. 8A, when the sleeve portion 160 engages the moveable contact member 81, the contact member 81 is pivoted out of electrical engagement with the stationary contact member 80 which opens the electrical switch 79. Preferably, the respective moveable contact members 74, 78 and 81 are positioned suitably along the bore 36 to have the respective electrical switches 73, 75 and 77 open simultaneously. The respective contact member of the switch 73, 75 and 77 may be connected through their respective terminals to function as shunts for respective circuits which will be opened when the plug 154 is inserted into bore 36 as described. Also, the plug 154 may have a hollow core wherein respective conductors (not shown) may extend axial for electrical connection to respective conductive portions 156, 158 and 160 of the plug and for resulting electrical connection to the moveable contact members 74, 78 and 81, respectively, when the plug 154 is inserted into the bore 36. Thus, the described jack module 12 has the capability of operating independently of the other jack module 14.

As shown in FIGS. 5 and 6A–6E, each of the terminals 63, 68 and 72 comprises a generally staight end portion of a respective wire which has an aligned intermediate portion 161, 162 and 163, respectively, connected integrally to an opposing end portion of the wire comprising stationary contact members 86, 83 and 90, respectively. Each of the stationary contact end portions 86, 83 and 90 is provided with a generally wave-like bend having a convex curvature directed inwardly of housing 18 and an opposing concave curvature facing outwardly thereof. The stationary contact end portions 86, 83 and 90 are press-fitted into respective slots 164, 166 and 167, the slot 164 extending vertically in the side surface 42 of housing 18 and the respective slots 166 and 167 extending vertically in the side surface 46 of housing 18 from the upper surface 54 to the lower surface 22 thereof. Each of the slots 164, 166 and 167 has an innermost wall surface curved complementary to the convex curvature of the wave-like bend in the inserted stationary contact end portions 86, 83 and 90, respectively. Adjacent the lower surface 22 of housing 18, each of the slots 164, 166 and 167 has a sufficient depth for permitting the crest of the wave-like bend in the respective stationary contact end portions 86, 83 and 90 to protrude into the slot 26 extending axially in the lower surface 22 of housing 18, as shown in FIGS. 6C–6F.

Moreover, adjacent the surface 22 of housing 18, the slot 164 is crossed by an adjacent end portion of an orthogonal slot 168 which is disposed longitudinally in side surface 42 sufficiently deep to protrude into the slot 26 in lower surface 22. Also, adjacent the surface 22 of housing 18, the slots 166–167 are crossed by end portions of respective orthogonal slots 170 and 171 which are disposed longitudinally in side surface 46 sufficiently deep to protrude into the slot 26 in lower surface 22. Slot 168 has an opposing end portion communicating with an orthogonal slot 172 which is disposed in side surface 42 substantially parallel with the slot 164 and sufficiently deep to communicate with the axial bore 38. The slots 170 and 171 have opposing end portions communicating respective orthogonal slots 174 and 175 which are disposed in side surface 46 substantially parallel with the slots 166 and 167, respectively, and sufficiently deep to communicate with the axial bore 38.

Between the respective parallel slots 164 and 172 the interposed wall portion of housing 18 has a cam surface 176 which slopes outwardly from a recessed landing 177 in upper surface 54 of housing 18 to the plane of longitudinal side surface 42 and slopes inwardly therefrom to the innermost wall surface of slot 168. Also, between the respective parallel slots 166 and 174 the interposed wall portion of housing 18 has a cam surface 178 which slopes outwardly from a recessed landing 179 in upper surface 54 of housing 18 to the plane of longitudinal side surface 46 and slopes inwardly therefrom to the innermost wall surface of slot 170. Moreover, between the respective parallel slos 167 and 175, the interposed wall portion of housing 18 has a cam surface 180 which slopes outwardly from a recessed landing 181 in upper surface 54 of housing 18 to the plane of longitudinal side surface 46 and slopes inwardly therefrom to the innermost wall surface of slot 171.

The landing 177 communicates through a groove 182 in upper surface 54 with a groove 184 disposed vertically in the side surface 46 and extending to the lower surface 22 of housing 18. Adjacent upper surface 54 a side of groove 184 is open to a juxtaposed cam surface 183 which is beveled to slope outwardly of housing 18 and terminate in the plane of side surface 46. Just below the cam surface 183 there is disposed in side surface 46 a box-like recess 185 which extends laterally from the groove 184. Also, the landing 179 communicates through a groove 186 in uper surface 54 with a groove 188 disposed vertically in side surface 42 and extending to the lower surface 22 of housing 18. Adjacent the upper surface 54, a side of groove 188 is open to a juxtaposed cam surface 189 which is beveled to slope outwardly of housing 18 and terminate in the plane of side surface 42. Just below the cam surface 189, there is disposed side surface 42 a box-like recess 190 which extends laterally from the groove 188. Moreover, the landing 181 communicates through a groove 192 in upper surface 54 with a groove 194 disposed vertically in side surface 42 and extending to the lower surface 22 of housing 18. Adjacent the upper surface 54, a side of groove 194 is open to a juxtaposed cam surface 195 which is beveled to slope outwardly of housing 18 and terminate in the plane of side surface 42. Just below the cam surface 195, there is disposed in side surface 42 a box-like recess 196 which extends laterally from the groove 194.

Terminal 69 comprises an end portion of a wire integrally connected to an aligned portion 198 having therein a laterally extending V-shaped bent portion 200 which is directed longitudinally of side surface 46 and toward the non-entrance end surface 34 of housing 18. The V-shaped bent portion 200 is integrally connected through an orthogonally bent portion 202 to a coplanar orthogonally bent portion 204. The portion 204 is integrally connected to an orthogonally bent portion having therein a V-shaped bent portion 206 which is directed inwardly of housing 18. The V-shaped bent porton 206 is integrally connected to an orthogonally bent end portion comprising moveable contact member 88. During installation, the terminal end portion 69 of the wire is inserted into the upper portion of groove 184 and urged downwardly thereof. The laterally V-shaped bent portion 200 rides over the cam surface 183 and snaps into the box-like recess 185. Simultaneously the moveable contact member 88 rides over the cam surface 176 and down into the slot 168 where it rests within the concave curvature of stationary contact member 86 and in electrical engagement with it. Also, the V-shaped bent portion 206 snaps into groove 172 and protrudes into a portion of axial bore 38 adjacent side wall 42. When the portion 202 seats in the groove 182 and the coplanar orthogonally bent portion 204 seats on the recessed landing 177 in upper surface 54 of housing 18 installation of the terminal 69 and the moveable contact member 88 is completed.

Terminal 62 comprises an end portion of a wire integrally connected to an aligned portion 208 having therein a laterally extending V-shaped bent portion 210 which is directed longitudinally of side surface 42 and toward the entrance end surface 30 of housing 18. The V-shaped bent portion 210 is integrally connected through an orthogonally bent portion 212 to a coplanar orthogonally bent portion 214. The portion 214 is integrally connected to an orthogonally bent portion having therein a V-shaped bent portion 216 which is directed inwardly of housing 18. The V-shaped bent portion 216 is integrally connected to an orthogonally bent end portion comprising moveable contact member 84. During installation, the terminal end portion 62 of the wire is inserted into the upper portion of groove 188 and urged downwardly thereof. The laterally extending V-shaped bent portion 210 rides over the cam surface 199 and snaps into the box-like recess 190. Simultaneously, the moveable contact member 84 rides over the cam surface 178 and down into the slot 170 where it rests within the concave curvature of stationary contact member 83. Also, the V-shaped bent portion 216 snaps into the groove 174 and protrudes into a portion of axial bore 38 adjacent side surface 46. When the portion 212 seats in groove 186 and the coplanar orthogonally bent portion 214 seats on the recessed landing 179 in upper surface 54 of housing 18 installation of terminal 62 and moveable contact member 84 is completed.

Terminal 66 comprises an end portion of a wire integrally connected to an aligned portion 218 having therein a laterally extending V-shaped bent portion 220 which is directed longitudinally of said surface 42 and toward the entrance end surface 30 of housing 18. The V-shaped bent portion 220 is integrally connected through an orthogonally bent portion 222 to a coplanar orthogonally bent portion 224. The portion 224 is integrally connected to an orthogonally bent portion having therein a V-shaped bent portion 226 which is directed inwardly of housing 18. The V-shaped bent portion 226 is integrally connected to an orthogonally bent end portion comprising moveable contact member 91. During installation, the terminal end potion 66 of the wire is inserted into the upper portion of groove 194 and urged downwardly thereof. The laterally extending V-shaped bent portion 220 rides over the cam surface 195 and snaps into the box-like reces 196. Simultaneously, the moveable contact member 91 rides over the cam surface 180 and down into the slot 171 where it rests within the concave curvature of stationary contact member 90. Also, the V-shaped bent portion 226 snaps into groove 175 and protrudes into a portion of axial bore 38 adjacent side surface 46. When the portion 222 seats in groove 192 and the coplanar orthogonally bent portion 224 seats on the recessed landing 181 in upper surface 54 of housing 18 installation of terminal 66 and moveable contact member 91 is completed.

Thus, the jack module 14 is provided with a second array of wire terminal end portions 62, 63 66, 68, 69 and 72 which are disposed within the longitudinal side surfaces 42 and 46, respectively. The terminal end portions 63, 68 and 72 are integrally connected to the stationary contact members 86, 83 and 90, respectively, and the terminal end portions 69, 62 and 66 are integrally connected to the moveable contact members 88, 84 and 91, respectively. According when the wire terminals 63, 68 and 72 are urged axially into respective close-fitting holes in a connecting device (not shown), the resulting pressure forces transmitted through these terminals are resisted by the respective lateral V-shaped bent portions 86, 83 and 90 bearing against the upper wall surface of the slot 26 extending axially in the lower surface 22 of housing 18. Also, when the wire terminals 69, 62 and 66 are urged axially into respective close-fitting holes in a connecting device (not shown), the resulting pressure transmitted through these terminals is resisted by the lateral V-shaped bent portions 200, 210 and 220, respectively, bearing resiliently against wall surfaces of the box-like recesses 185, 190 and 196, respectively. Therefore, each of the wires has a laterally V-shaped bent portion 86, 83, 90, 200, 210 and 220, respectively, which resists axially directed forces exerted on the terminal end portions 63, 68, 72, 69, 62 and 66, respectively, for protecting the stationary contact members 86, 83 and 90, respectively, as well as the moveable contact members 88, 84 and 91, respectively.

Figure 7A:
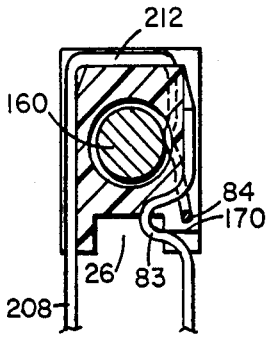
FIGS. 7A-7C are respective transverse sectional views of the upper jack module shown in FIGS. 6A-6B and illustrating actuated conditions of the respective component switches depicted in FIGS. 6C-6E.
Figure 7B:
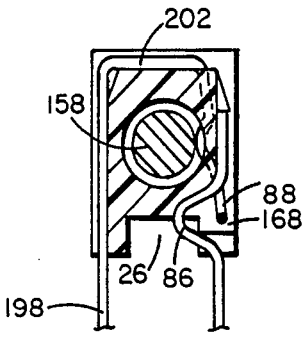
Figure 7C:
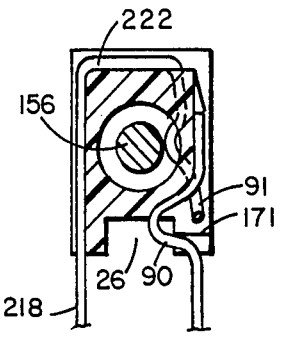

As shown in FIG. 6A, in operation, the plug 230, previously described may be inserted into the bore 38. As shown in FIG. 7C, when the conductive tip portion 156, the V-shaped bend 226, the moveable contact member 91 is pivoted out of electrical engagement with the stationary contact member 90 which opens the electrical switch 89. As shown in FIG. 7B, when the ring portion 158 engages the V-shaped bend 206, the moveable contact member 88 is pivoted out of electrical engagement with the stationary contace member 86 which opens the electrical switch 88. As shown in FIG. 7A, when the sleeve 160 engages the V-shaped bend 216, the moveable contact member 84 is pivoted out of electrical engagement with the stationary contact member 83 which opens the electrical switch 85. Thus, the described jack module 14 has the capability of operating independently of the other jack module 12.

Figure 3:
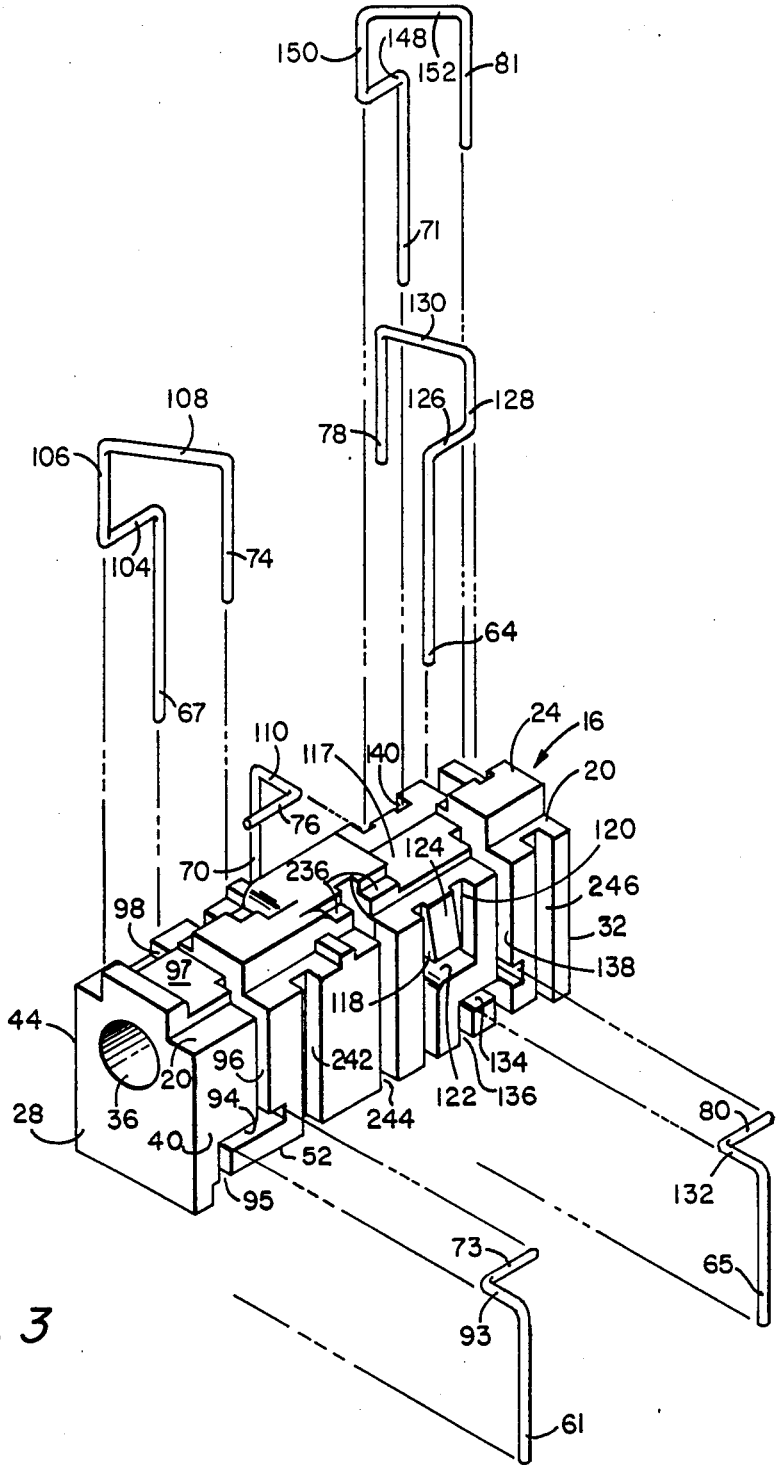
FIG. 3 is an exploded isometric view of the lower jack module shown in FIG. 2A.
Figure 5:
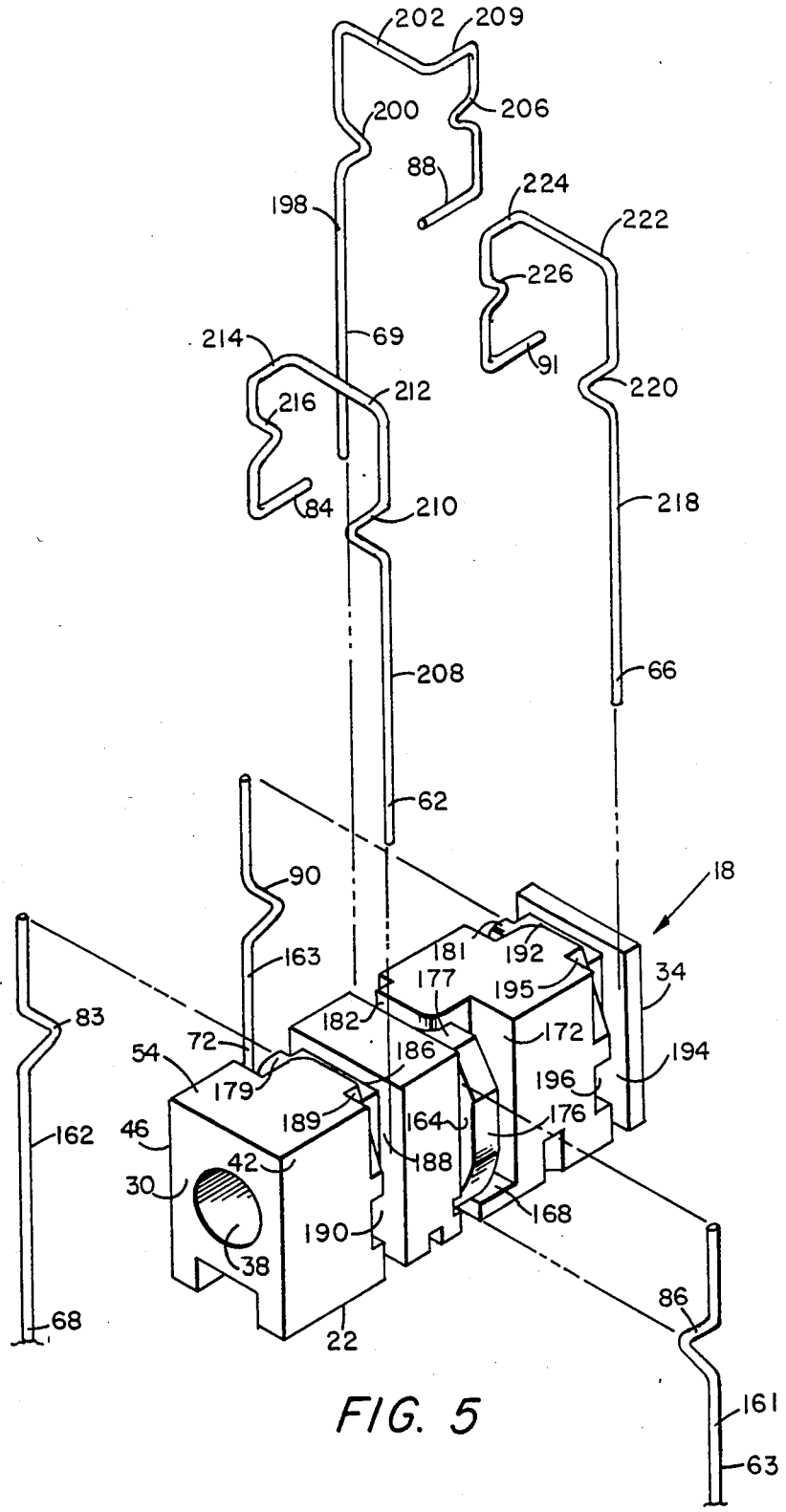
FIG. 5 is an exploded isometric view of the upper jack module shown in FIG. 2B.

Referring again to FIGS. 1A and 1B, it may be seen that the jack module 14, in accordance with this invention, is mounted atop the jack module 12 by inserting the ridge 24 snugly into the slot 26. There is provided in the longitudinal side surface 44 of housing **18*m* adjacent the lower surface 22 thereof, a notch 230 which accepts the bight portion 130 integrally connected to moveable contact member 78. Also, there is provided in the longitudinal side surface 46 of housing 18, adjacent the lower surfsce 22 thereof, respective notches 232 and 234 which accept bight portions 108 and 152 integrally connected to moveable contact members 74 and 81, respectively. Furthermore, as shown in FIG. 3, landings 236, 238 and 240 for receiving the portions of the stationary and moveable contact members of electrical switches 87, 89 and 85**, respectively.

The linear series of wire terminal members 62, 63 and 66 extending downwardly from lower surfaces 22 of housing 18 adjacent are longitudinal side surface 42 are press-fitted into respective grooves 242, 244 and 246 extending vertically in the longitudinal side surface 40 of housing 16 from the top surface 20 to the lower surface 52 thereof to hold the modules 12, 14 together. That is the friction between the inner surfaces of grooves 242, 244 and 246 and the wire terminals in such grooves restrain pulling of the modules 12, 14 vertically apart after their engagement. Also, the linear series of wire terminal members 68, 69 and 72 extending downwardly from the lower surface 22 of housing 18 are press-fitted into respective grooves 248, 250 and 252 extending vertically in the longitudinal side surface 44 of housing 16 from the top surface 20 to the lower surface 56 thereof. As a result, the linear series of wire terminals 62, 63 and 66, respectively and the linear series of wire terminals 68, 69 and 72, respectively, interleave in spaced relationship with the linear series of wire terminals 61, 63 and 64, respectively, and the linear series of wire terminals 67, 70 and 71 to form a common array of wire terminals 61–72, respectively. Thus, the common array of wire terminals 61–72, respectively, for the vertically stacked pair of jack modules 12 and 14, respectively, comprising the electrical jack assembly 10 requires less space for a similar array of terminal-receiving holes than would be required for a ganged array of side-by-side modules.

From the foregoing, it will be apparent that all of the objectives of this invention have been achieved by the structures described herein. It also will be apparent, however, that various changes may be made by those skilled in the art without departing from the spirit of the invention as expresed in the appended claims. It is to be understood, therefore, that all matter shown and described is to be interpreted as illustrative and not in a limiting sense.

What is claimed is:

1. An electrical jack assembly comprising:

a first electrical jack including an external surface having therein first recess means disposed for receiving electrical conductors and including a pair of first electrical conductors having contact means comprised of respective switch component end portions of the first electrical conductors disposed in electrically contactable relationship with one another in said first recess means for forming therein a first electrical switch, at least one of said switch component end portions of the first electrical conductors being engageable by a jack plug extended in a first direction relative to said first electrical switch, said switch component end portions of the first electrical conductors being electrically connected to respective terminal end portions thereof extending from a base portion of the first electrical jack in a second direction substantially orthogonal to said first direction; and a second electrical jack including an external surface having therein second recess means disposed for receiving electrical conductors and including a pair of second electrical conductors having contact means comprised of respective switch component end portions of said second electrical conductors disposed in electrically contactable relationship with one another in said second recess means for forming therein a second electrical switch, at least one said switch component end portions of the second electrical conductors being engageable by a jack plug extended in a direction substantially parallel with said first direction, a proximal portion of the second electrical jack overlying a distal portion of the first electrical jack, said switch component end portions of the second electrical conductors being electrically connected to respective terminal end portions thereof said terminal end portions of the second electrical conductors extending from said base portion of the first electrical jack in said second direction substantially orthogonal to said first direction.

2. An electrical jack assembly as set forth in claim 1 wherein said first and second electrical conductors comprise respective wires, each having the switch component end portion thereof integrally connected to the terminal end portion thereof through a respective intermediate portion of the wire.

3. An electrical jack assembly as set forth in claim 2 wherein the first recess means includes a plurality of open grooves formed in said external surface of the first electrical jack and said intermediate portions of the wires comprising the second electrical conductors pass through said open grooves in the external surface of said first electrical jack.

4. An electrical jack assembly comprising:

(a) a first module having first wall means defining an open-ended bore along a first axis for receiving an axially inserted first jack plug, said wall means including a first external surface extended along said first axis and having disposed therein first recess means for receiving electrical contact members, said first module including a plurality of first electrical switches disposed in said first recess means in axially spaced relationship along said first axis, each of said first electrical switches having a respective pair of first electrical contact members, one of said contact members in each pair thereof being engaged by said first jack plug for actuating said switch, the first electrical contact members having respective terminating end portions protruding from a base wall portion of said first wall means in a direction substantially orthogonal to said first axis; and (b) a second module mounted on the first module and having second wall means defining an open-ended bore along a second axis substantially parallel with said first axis for receiving an axially inserted second jack plug, said second wall means including a second external surface extended along said second axis and having disposed therein second recess means for receiving electrical contact members, said second module including a plurality of second electrical switches disposed in said second recess means in axially spaced relationship along said second axis, each of said second electrical switches having a respective pair of second electrical contact members, one of said contact members in each pair thereof being engaged by said second jack plug for actuating said switch, the second electrical contact members having respective terminating end portions extending past a proximal wall portion of said second wall means and protruding from said base wall portion of the first wall means in said direction substantially orthogonal to said first axis.

5. The assembly recited in claim 4 wherein the respective terminating end portions of the first electrical contact members are interspersed among the respective terminating end portions of the second electrical contact members protruding from said base wall portion of the first wall means.

6. The assembly recited in claim 5 wherein the portions of the second electrical contact members extending past the proximal wall portion of the second wall means are disposed within said first recess means in said external surface of the first wall means.

7. The assembly recited in claim 6 wherein the first and second recess means comprise respective pluralities of open grooves disposed in said external surfaces of the respective first and second wall means; and the first and second electrical contact members are comprised of respective lengths of resilient wire.

8. The assembly recited in claim 7 wherein said respective lengths of wire have bends therein for fitting into respective preselected portions of said open grooves formed in said external surface of the first wall means.

9. An electrical jack assembly comprising:

first housing means including a first dielectric body having therein an open-ended first bore for receiving an electrical jack plug and having a plurality of first external surfaces extended substantially parallel with said first bore, said first external surfaces including a pair of opposing side surfaces orthogonally disposed with respect to proximal and distal surfaces of said first dielectric body, the opposing side surfaces and the distal surface of said first dielectric body having disposed therein respective first recess means for receiving electrical conductors, the respective first recess means in said opposing side surfaces having portions communicating with said first bore;

first electrical switch means disposed in said first recess means and including a plurality of first electrical switches axially spaced apart along said first bore for actuation by said jack plug, each of said first electrical switches including a pair of first electrical conductors operatively disposed in the first recess means in one of said opposing side surfaces of the first dielectric body, one of said first electrical conductors in each of said pairs being moveable with respect to the other one of said first electrical conductors, each of said moveable first electrical conductors being extended transversely through a portion of said first bore, through said first recess means in said distal surface and into said first recess means in the opposing side surface of said first dielectric body;

second housing means including a second dielectric body having therein an open-ended second bore for receiving said jack plug, said second dielectric body having an external proximal surface disposed on said distal surface of the first dielectric body and having said second bore aligned substantially parallel with said first bore, the second dielectric body having a plurality of second external surfaces including a pair of opposing side surfaces and an orthogonaly disposed distal surface extending along said second bore and provided with respective second recess means for having disposed therein electrical conductors, the respective second recess means provided in said opposing side surfaces of the second dielectric body having portions communicating with said second bore; and second electrical switch means including a plurality of second electrical switches disposed within said second recess means in said opposing side surfaces of the second dielectric body and axially spaced apart along said second bore, each of said second electrical switches having a moveable member extended transversely through a respective portion of said second bore, through said second recess means in said distal surface and into said second recess means in the opposing side surface of said second dielectric body.

10. An electrical jack assembly as set forth in claim 9 wherein each of said respective first and second recess means comprises a plurality of open grooves disposed in said external surface of the dielectric body, and each of said first and second electrical switches comprises a pair of moveable and stationary wire members having respective switch component end portions disposed in electrically contactable relationship with one another and connected integrally through respective intermediate portions press-fitted into said open grooves to respective terminal end portions of the wire members extending in a common array from said proximal surface of the first dielectric body, the intermediate portions of the wire members comprising said electrical switches being press-fitted into open grooves in said opposing side surfaces of the first dielectric body as well as being press-fitted into open grooves in said opposing side surfaces of the second dielectric body for releaseably securing said second dielectric body to said first dielectric body of the housing means.

11. An electrical jack assembly comprising:

a first electric jack module including a body having therein a plug-receiving bore and having a plurality of external surfaces disposed substantially parallel with said bore, said external surfaces including a pair of opposing side surfaces disposed orthogonally between respective opposing proximal and distal surfaces of said body, the first electrical jack module also including first plurality of terminal end portions extended from said proximal surface of said body; and a second electrical jack module mounted on said distal surface of said body and having a second plurality of terminal end portions interposed in mutually spaced relationship with the terminal end portions of said first plurality in a common array of terminal end portions extended from said proximal surface of the body, said opposing side surfaces of the body being provided with open grooves and said terminal end portions being press-fitted into respective ones of said open grooves, at least one of said grooves and said terminal end portion press-fitted therein having respective comforming laterally directed portions, and said side surface having said one groove therein being provided with cam surface means disposed for directing said laterally directed portion of said terminal end portion into said laterally directed portion of said one groove.

12. An electrical jack assembly comprising:

first housing means including a first dielectric body having therein an open-ended first bore for receiving an electrical jack plug and having a plurality of first external surfaces extended substantially parallel with said first bore, said first external surfaces including a pair of opposing side surfaces orthogonally disposed with respect to proximal and distal surfaces of the first dielectric body, the opposing side surfaces of said first dielectric body having disposed therein respective first recess means for receiving electrical conductors;

first electrical switch means disposed in said first recess means and including a plurality of first electrical switches spaced apart along said first bore for actuation by said jack plug, each of said first electrical switches including a pair of first electrical conductors extended through said first recess means to said proximal surface of the first dielectric body;

second housing means including a second dielectric body having therein an open-ended second bore for receiving said jack plug, said second dielectric body having a plurality of second external surfaces extended substantially parallel with said second bore, said second external surfaces including a pair of opposing side surfaces orthogonally disposed with respect to proximal and distal surfaces of the second dielectric body, the proximal surface of said second dielectric body being disposed on said distal surface of the first dielectric body and the opposing side surfaces of said second dielectric body being substantially aligned with respective opposing side surfaces of said first dielectric body, the opposing side surfaces of said second dielectric body having therein respective second recess means disposed in communication with said first recess means; and second electrical switch means disposed in said second recess means and including a plurality of second electrical switches spaced apart along said second bore for actuation by said jack plug, each of said second electrical switches including a pair of second electrical conductors extended through said second recess means and through said first recess means to said proximal surface of the first dielectric body.

13. An electrical jack assembly as set forth in claim 12 wherein said pair of first electrical conductors in each of said first electrical switches have respective switch component end portions disposed in operative relationship with one another in said first recess means; and said pair of second electrical conductors in each of said second electrical switches have respective switch component end portions disposed in operative relationship with one another in said second recess means.

14. An electrical jack assembly as set forth in claim 12 wherein each of said first electrical conductors and each of said second electrical conductors have respective terminal end portions extended from said proximal surface of the first dielectric body in a common array.

15. An electrical jack assembly as set forth in claim 14 wherein a plurality of said second electrical conductors are provided with housing interlocking means for holding said second dielectric body on said first dielectric body and comprising each of said second electrical conductors of said plurality having a respective intermediate portion extended from said proximal surface of the first dielectric body, through said first and second recess means in respective aligned side surfaces of the first and second dielectric bodies, over the distal surface of the second dielectric body and into said second recess means in the opposing side surface of the second dielectric body.

16. An electrical jack assembly as set forth in claim 14 wherein a plurality of said first electrical conductors have respective intermediate portions extended from said proximal surface of the first dielectric body, through said first recess means in one of the opposing side surfaces, over said distal surface of the first dielectric body and into said first recess means in the other of said opposing side surfaces of the first dielectric body.

* * * * *